US007459851B2

(12) United States Patent
Yoo et al.

(10) Patent No.: US 7,459,851 B2
(45) Date of Patent: Dec. 2, 2008

(54) PLASMA DISPLAY PANEL HAVING DELTA PIXEL ARRANGEMENT

(75) Inventors: Min-Sun Yoo, Suwon-si (KR); Jeong-Nam Kim, Suwon-si (KR); Dong-Ju Woo, Suwon-si (KR); Sang-Hoon Yim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 429 days.

(21) Appl. No.: 10/992,659

(22) Filed: Nov. 22, 2004

(65) Prior Publication Data

US 2005/0116645 A1 Jun. 2, 2005

(30) Foreign Application Priority Data

Nov. 29, 2003 (KR) ..... 10-2003-0086145

(51) Int. Cl.
*H01J 17/49* (2006.01)

(52) U.S. Cl. ..... 313/582; 313/583; 313/585

(58) Field of Classification Search ..... 313/582
See application file for complete search history.

(56) References Cited

U.S. PATENT DOCUMENTS

| | | | | |
|---|---|---|---|---|
| 5,182,489 | A | 1/1993 | Sano | 313/485 |
| 6,281,628 | B1 | 8/2001 | Choi et al. | |
| 6,373,195 | B1 | 4/2002 | Whang et al. | |
| 6,376,986 | B1 | 4/2002 | Takagi et al. | 313/582 |
| 7,002,296 | B2 * | 2/2006 | Sano et al. | 313/583 |
| 2003/0117423 | A1 * | 6/2003 | Brown et al. | 345/690 |
| 2007/0085863 | A1 * | 4/2007 | Moriya et al. | 345/694 |

FOREIGN PATENT DOCUMENTS

| | | |
|---|---|---|
| JP | 03084831 | 4/1991 |
| JP | 11073154 | 3/1999 |

(Continued)

OTHER PUBLICATIONS

"1998 Display Exposition and Conference", Society for Information Display (SID), San Jose, CA. pp. 1-7.

Cha Kung Yoon, et al., "Optimization of Delta Color Array for High-Definition PDP with High-Efficient Hexagonal Array Structure", Society for Information Display 2003 International Symposium Digest of Technical Papers, May 20, 2003, vol. XXXIV, Book I, pp. 140-143.

*Primary Examiner*—Sikha Roy
*Assistant Examiner*—Natalie K Walford
(74) *Attorney, Agent, or Firm*—H.C. Park & Associates, PLC

(57) ABSTRACT

A plasma display panel has red R, green G, and blue B subpixels arranged in a triangular configuration. The plasma display panel includes a first substrate and a second substrate separated from each other by a predetermined distance. Barrier ribs form a discharge space between the first substrate and the second substrate so that subpixels forming a pixel are arranged in a triangular configuration. Address electrodes may be formed on the first substrate and display electrodes may be formed on a surface of the second substrate to cross the address electrodes. A phosphor layer may be formed in the discharge space. An aspect ratio of the pixel is a horizontal pitch of the pixel divided by a vertical pitch of the pixel, and the aspect ratio of the pixel is in a range of about 0.8 to about 1.0.

20 Claims, 3 Drawing Sheets

FOREIGN PATENT DOCUMENTS

| | | | |
|---|---|---|---|
| JP | 2000357459 | | 12/2000 |
| JP | 2001210241 | | 8/2001 |
| JP | 2003-043990 | | 2/2003 |
| JP | 2003208848 | | 7/2003 |
| KR | 2003071157 A | * | 9/2003 |

* cited by examiner

PLASMA DISPLAY PANEL HAVING DELTA PIXEL ARRANGEMENT

CROSS REFERENCE TO RELATED APPLICATION

This application claims priority to and the benefit of Korean Patent Application No. 10-2003-0086145, filed on Nov. 29, 2003, which is hereby incorporated by reference for all purposes as if fully set forth herein.

BACKGROUND OF THE INVENTION

1. Field of the Invention

The present invention relates to a plasma display panel (PDP) and, in particular, to a PDP having red (R), green (G), and blue (B) sub pixels arranged in a triangular configuration, which may also be referred to as a delta arrangement.

2. Discussion of the Background

Generally, a PDP uses a gas discharge that emits ultraviolet light to excite phosphors to realize predetermined images. Many consider Peps to be a next generation display because they may have large screen sizes and high resolution.

Depending on sub pixel arrangement, PDPs may be divided into two types. The first is a stripe-type PDP, in which the discharge cells are arranged in a stripe pattern (or in-line pattern). The other is a delta-type PDP, in which the discharge cells are arranged in a triangular (i.e., delta) shape.

In the delta-type PDP, a plurality of R, G, and B sub pixels may be formed in the delta configuration between front and rear substrates. Sustain and address electrodes may be formed on the front and rear substrates, respectively, at locations corresponding to the sub pixel positions. Closed, quadrilateral-shaped barrier ribs may be used to form the actual delta arrangement of the R, G, and B sub pixels.

In such a delta-type PDP, an address voltage may be applied between an address electrode and one of a pair of the sustain electrodes that correspond to the selected sub pixel to address it. A discharge sustain voltage may be applied alternately to the pair of the sustain electrodes to perform a sustaining step. As a result, ultraviolet rays generated in the sustaining step excite discharge cell phosphors to emit visible light to thereby display desired images. U.S. Pat. Nos. 5,182,489 and 6,373,195 disclose related technologies.

The delta-type PDPs may also be formed by modifying the typical PDP structure formed with the linear barrier ribs, as disclosed in U.S. Pat. No. 6,376,986. In this case, the R, G, and B sub pixels may be formed into roughly hexagonal shapes by barrier ribs arranged in a meandering configuration.

In the PDPs mentioned above, the sub pixels may be arranged in a triangular configuration so that when the R, G, and B sub pixels are grouped together to form one pixel, the width of each R, G, and B sub pixel may be greater than approximately one-third of the pitch (horizontal pitch) of the pixel. Therefore, higher definition may be possible as compared to the PDP having sub pixels formed in an in-line configuration. Thus, an area of the non-illuminating regions in the screen may be reduced, thereby achieving higher luminance.

Although the conventional delta-type PDP may have these advantages, no delta-type PDPs disclosed up to date appear to disclose similar characteristics for the sub pixels. Therefore, the overall characteristics of the delta-type PDP (e.g., luminance) may not be easily maximized, which may cause difficulties in producing the actual PDP.

For example, in the PDP of U.S. Pat. No. 6,376,986, open sub pixels are formed in a column direction by barrier ribs arranged in a meandering configuration. This may limit the ability to maximize the discharge space of the unit pixel.

Also, in the PDP of U.S. Pat. No. 5,182,489, while a single sub pixel may be formed by closed barrier ribs, it is formed in a quadrilateral shape. The ability to maximize the single subpixel's luminance characteristics may be limited due to the relation between an area of the display electrode provided within the quadrilateral pixel and the diffusion of discharge within the quadrilateral pixel.

SUMMARY OF THE INVENTION

This invention provides a delta-type PDP with sub pixels having an optimized shape and arrangement that may improve the PDP's characteristics.

Additional features of the invention will be set forth in the description which follows, and in part will be apparent from the description, or may be learned by practice of the invention.

The present invention discloses a PDP comprising a first substrate and a second substrate separated from each other by a predetermined distance. Barrier ribs form a discharge space between the first substrate and the second substrate such that sub pixels comprising a pixel are arranged in a triangular configuration. Address electrodes are formed on the first substrate, and display electrodes are formed on a surface of the second substrate along a direction crossing the address electrodes. Phosphor layers are formed within the discharge space. An aspect ratio of the pixel is a horizontal pitch of the pixel divided by a vertical pitch of the pixel, and the aspect ratio of the pixel is in a range of about 0.8 to about 1.0.

The present invention also discloses a PDP comprising a pixel formed between a first substrate and a second substrate, wherein the pixel comprises three sub pixels arranged in a delta arrangement. An aspect ratio of the pixel is a horizontal pitch of the pixel divided by a vertical pitch of the pixel, and the aspect ratio of the pixel is in a range of about 0.8 to about 1.0. An aspect ratio of a sub pixel is a horizontal length of the sub pixel divided by a vertical length of the sub pixel, and the aspect ratio of the sub pixel is in a range of about 1.1 to about 1.34.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION

The present invention will be described more fully hereinafter with reference to the accompanying drawings.

Figure 1:
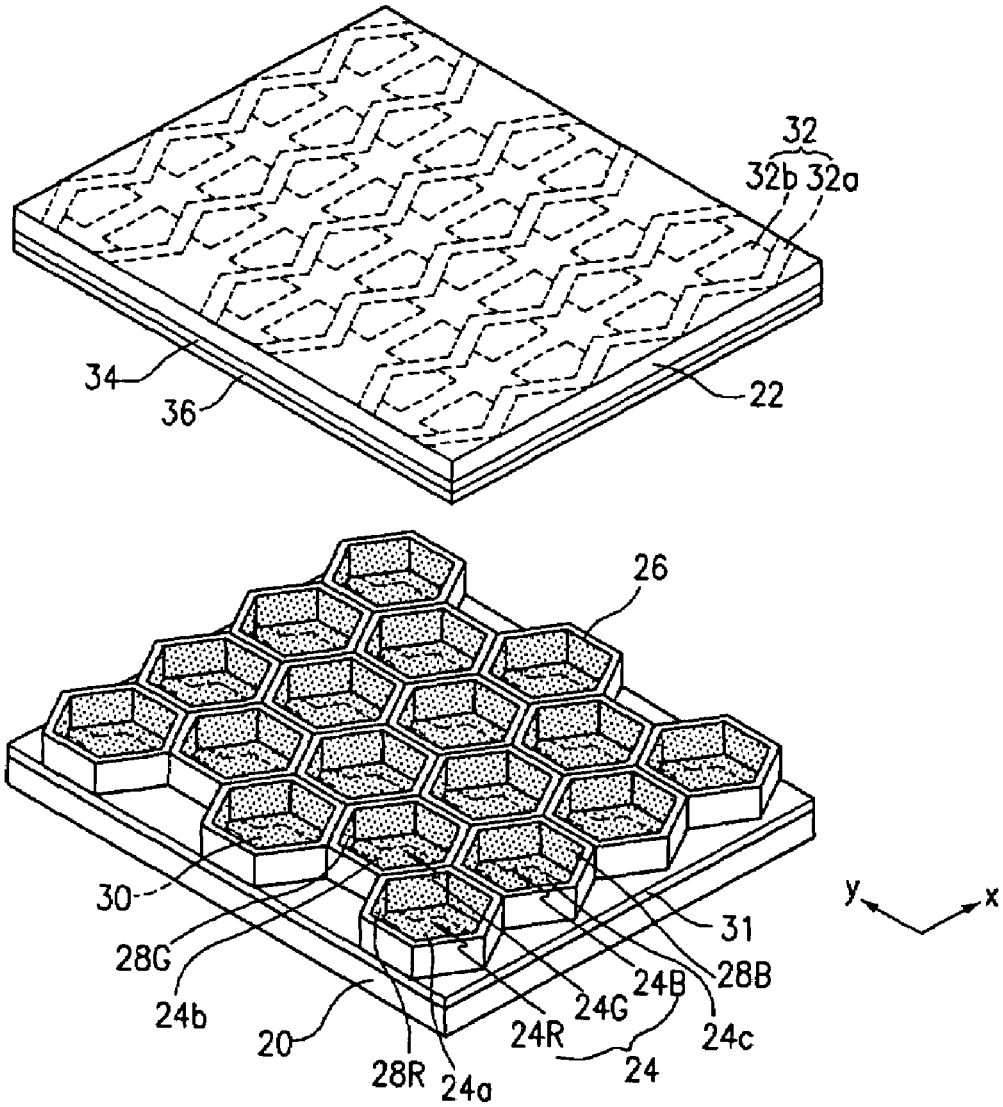
FIG. 1 is a partial exploded perspective view of a PDP according to an exemplary embodiment of the present invention.
Figure 2:
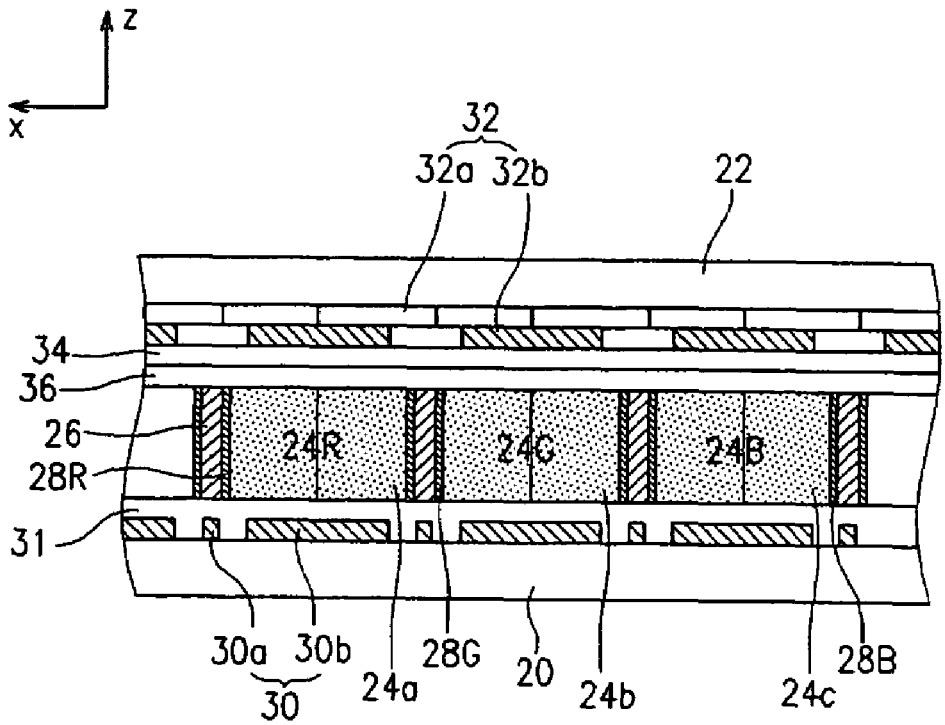
FIG. 2 is a partial sectional view showing an assembled PDP according to an exemplary embodiment of the present invention.

FIG. 1 is a partial exploded perspective view showing a disassembled PDP according to an exemplary embodiment of the present invention, and FIG. 2 is a partial sectional view showing the assembled PDP according to the exemplary embodiment.

As shown in FIG. 1 and FIG. 2, a group of R, G, and B sub pixels, comprising one pixel, may be arranged in a triangular shape to form a delta-type PDP.

More specifically, the PDP includes a rear substrate 20 and a front substrate 22 provided substantially in parallel to each other and with a predetermined gap there between.

Barrier ribs 26 may be formed in a predetermined pattern between the rear substrate 20 and the front substrate 22, thereby defining pixels 24. Each pixel 24 comprises 3 sub pixels 24R, 24G, 24B that may be arranged in a triangular configuration (see FIG. 3).

The barrier ribs 26 form discharge spaces 24*a*, 24*b*, 24*c*, which correspond to the sub pixels 24R, 24G, 24B, respectively.

Since each of the sub pixels 24R, 24G, 24B in the present exemplary embodiment may be formed in a roughly hexagonal shape, the barrier ribs 26 forming the sub pixels 24R, 24G, 24B may also be formed in the roughly hexagonal shape. Therefore, the discharge spaces 24*a*, 24*b*, 24*c* also have a roughly hexagonal shape with an open top.

The discharge spaces 24*a*, 24*b*, 24*c* are provided with a discharge gas required for plasma discharge. Also, R, G, and B phosphor layers 28R, 28G, 28B may be formed in the corresponding sub pixels 24R, 24G, 24B, respectively. The phosphor layers 28R, 28G, 28B may be formed on the bottom surface of the discharge spaces 24*a*, 24*b*, 24*c* and on the sidewalls of the barrier ribs 26.

A plurality of address electrodes 30 (30*a* and 30*b*) may be formed along a Y direction on the rear substrate 20. A dielectric layer 31 may cover the address electrodes 30 (30*a* and 30*b*), and the barrier ribs 26 may be formed on the dielectric layer 31.

A plurality of display electrodes 32 may be formed along an X direction on a surface of the front substrate 22 that faces the rear substrate 20. The display electrodes 32 include bus electrodes 32*a*, which may be formed along the X direction and following the shape of the barrier ribs 26, and transparent electrodes 32*b*, which may be formed protruding from the bus electrodes 32*a* and positioned in the discharge spaces 24*a*, 24*b*, 24*c* of the sub pixels 24R, 24G, 24B.

The bus electrodes 32*a* are preferably made of a metallic material and positioned following the shape of the barrier ribs 26 so that they zigzag along the X direction of the front substrate 22. Bus electrodes 32*a* may be positioned over the barrier ribs 26 so that the visible light generated in the discharge spaces 24*a*, 24*b*, 24*c* does not flow through them.

Further, the transparent electrodes 32*b* are made of a transparent material, such as Indium Tin Oxide (ITO). The transparent electrodes 32*b* may be formed alternately protruding along each of the bus electrodes 32*a* and corresponding to the discharge spaces 24*a*, 24*b*, 24*c*. Therefore, a pair of transparent electrodes 32*b* may face each other with a predetermined interval there between at positions corresponding to the discharge spaces 24*a*, 24*b*, 24*c*.

Additionally, a dielectric layer 34 may cover the display electrodes 32, and a protection layer 36, which may be made of magnesium oxide (MgO), may cover the dielectric layer 34.

The shape and arrangement of sub pixels and pixels may affect PDP characteristics such as resolution, discharge efficiency, voltage margin, and luminance. Since both the sub pixels and the pixels may affect the PDP's characteristics, it is important to find optimized ranges for their shapes and arrangements.

Figure 3:
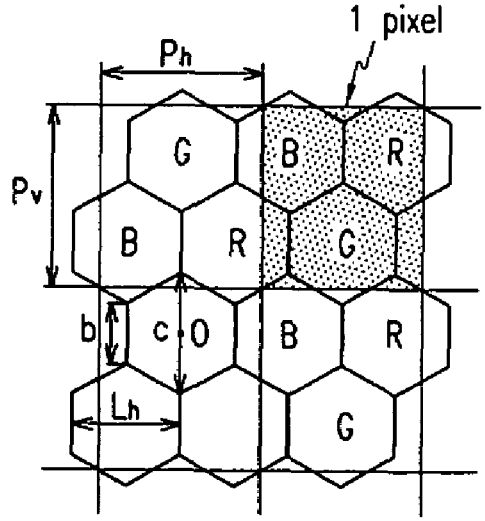
FIG. 3 is a schematic view showing a sub pixel arrangement and the pitch of the pixel in the PDP of FIG. 2.
Figure 4:
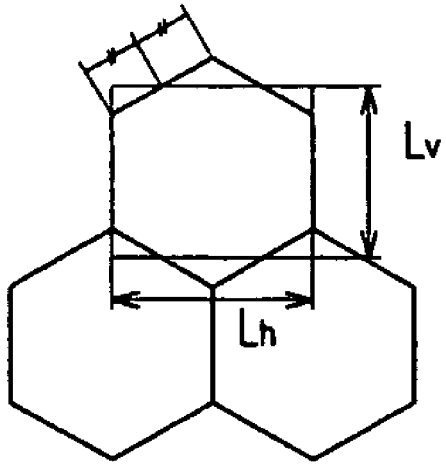
FIG. 4 is a schematic view showing horizontal and vertical lengths of the sub pixel according to an exemplary embodiment of the present invention.

FIG. 3 is a schematic view showing a sub pixel arrangement and the pitch of the pixel in the PDP, and FIG. 4 is a schematic view showing the horizontal and vertical lengths of the sub pixel, according to exemplary embodiments of the present invention.

Referring to FIG. 3, a pixel comprises a group of R, G, and B sub pixels arranged in a triangular configuration. Each pixel may also be defined as a rectangle having sides equal to the horizontal pitch $P_h$ and the vertical pitch $P_v$ of each pixel. The horizontal pitch $P_h$ may equal 1½ $L_h$, where $L_h$ is the horizontal length of the sub pixel. The vertical pitch $P_v$ may equal b+c, where b and c are the lengths of the vertical short axis and the vertical long axis of each sub pixel, respectively. The pixel aspect ratio may be defined as $P_h/P_v$.

The pixel aspect ratio $P_h/P_v$ may satisfy the condition: $0.8 \leqq P_h/P_v \leqq 1$. Furthermore, some exemplary embodiments may have a pixel aspect ratio within the range $0.85 \leqq P_h/P_v \leqq 0.95$. A pixel having an aspect ratio within either range shows an increase in the vertical length of the pixel and may be at an advantage for a high speed operation and a higher success rate for the discharge.

When the pixel aspect ratio $P_h/P_v$ is less than 0.8, picture quality may be degraded. On the other hand, when it is greater than 1.0, the success rate for the discharge in the high speed operation may decrease.

It may be difficult to design a non-square pixel having an aspect ratio of 1:1 due to fabrication process limitations. Nevertheless, the non-square pixel is preferably designed so that its aspect ratio is close to 1:1 In an exemplary embodiment of the present invention, the closer the pixel aspect ratio is to 1:1, the more preferable the pixel is for the PDP. Given a PDP with a predetermined size and fixed horizontal resolution, an increased vertical resolution increases the number of the scanning lines when the aspect ratio is larger than 1.0. Applying the single scan operation to an increased number of scanning lines reduces the PDP's sustaining time. Therefore, when the pixel aspect ratio is set within the range specified above, a lower vertical resolution may be applied at a given horizontal resolution than that corresponding to the previous model.

Referring to FIG. 4, $L_h$ and $L_v$ are the horizontal length and vertical length of the sub pixels forming each pixel of the PDP, respectively. The horizontal length $L_h$ may be defined as a maximum width of a sub pixel in the horizontal direction, and the vertical length $L_v$ may be defined as a vertical length of a rectangle having the horizontal length $L_h$ and an area approximately equal to an area of the polygonal sub pixel. The sub pixel aspect ratio may be defined as $L_h/L_v$.

The sub pixel aspect ratio $L_h/L_v$ may satisfy the relationship: $1.1 \leqq P_h/L_v \leqq 1.34$. Furthermore, it may be preferable to set the sub pixel aspect ratio $L_h/L_v$ in a range from 1.15 to 1.25.

When the sub pixel aspect ratio $L_h/L_v$ is less than 1.1, the luminance and efficiency may decrease due to a short in the absolute area of an electrode. In an exemplary embodiment, if a $L_h/L_v$ value is greater than 1.34, cathode lighting may not be completed due to a shorter length of the absolute vertical length than is required for the operation margin.

As described above and shown in FIG. 3, the subpixel's vertical long axis is a line connecting two sub pixel vertices and passing through its center O, and its vertical short axis is a line parallel to the vertical long axis and connecting two other vertices. A sub pixel may be formed symmetrical to its vertical long axis, and it may have a roughly hexagonal shape. Additionally, the sub pixel may be formed with a ratio c/b in the range of 1.5 to 5, where c is the length of the vertical long axis, and b is the length of the vertical short axis. It may be preferable for the c/b ratio to be in the range of 2.5 to 3.5.

When the c/b ratio is less than 1.5, a high resolution margin may decrease, and when it is greater than 5, the luminance may decrease.

The PDP's luminance may increase by more than 10% when a hexagonal sub pixel has a c/b ratio greater than 1.5. When a c/b ratio is greater than 2.5 and less than 3.5, the luminance may increase by more than approximately 15% as compared with a rectangular sub pixel with a c/b ratio of 1.0.

Additionally, improvement in the PDP's efficiency and the addressing voltage margin may be expected when the c/b ratio is within the range of 1.5 to 5.

The optimal number of the vertical scanning lines may be calculated at given horizontal resolutions of HDTV models currently available. Table 1 shows 512, 640 and 768 vertical scanning lines for each horizontal resolution of 1024, 1280, and 1366. The pixel aspect ratio $P_H/P_V$ and the sub pixel aspect ratio $L_H/L_V$ are calculated for each case.

TABLE 1

| | V | | | | | |
|---|---|---|---|---|---|---|
| | 512 scan | | 640 scan | | 768 scan | |
| H | pixel | subpixel | pixel | subpixel | pixel | subpixel |
| 1024 | 0.9 | 1.19 | 1.1 | 1.48 | 1.3 | 1.78 |
| 1280 | 0.8 | 0.95 | 0.9 | 1.19 | 1.1 | 1.42 |
| 1366 | 0.7 | 0.89 | 0.8 | 1.11 | 1.0 | 1.33 |

As Table 1 shows, resolutions having sub pixel and pixel aspect ratios within the ranges noted above include 1024×512, 1280×640, and 1366×768, which may correspond to a PDP having a diagonal size of 32 inches, 37 inches, and 42 inches, respectively.

When an HDTV has a screen ratio of 16:9, 576 and 720 vertical scanning lines correspond to the horizontal resolutions of 1024 and 1280, respectively. The PDP with the delta arrangement according to exemplary embodiments of the present embodiment, however, may have an advantage in terms of the vertical resolution over the conventional PDP with a stripe arrangement. In general, it is reported that the delta arrangement may be twice as good as the stripe arrangement. Therefore, a delta-type PDP having a resolution of 1280×640 may have similar picture quality to a stripe-type PDP having a resolution of 1280×1280.

As explained above, according to exemplary embodiments of the present invention, optimizing the shapes of both the pixel and the sub pixel may provide a PDP with high performance and high picture quality at a low cost.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising;

a first substrate;

a second substrate provided at a predetermined distance from the first substrate;

barrier ribs forming a discharge space between the first substrate and the second substrate such that subpixels comprising a pixel are arranged in a triangular configuration;

a plurality of address electrodes formed on a surface of the first substrate;

a plurality of display electrodes formed on a surface of the second substrate along a direction crossing the address electrodes; and phosphor layers formed within the discharge space, wherein an aspect ratio of the pixel is a horizontal pitch of the pixel divided by a vertical pitch of the pixel;

wherein the aspect ratio of the pixel is in a range of about 0.8 to about 1.0, and the horizontal pitch of the pixel is less than a total horizontal length of the subpixels comprising the pixel.

2. The PDP of claim 1, wherein the aspect ratio of the pixel is in a range of about 0.85 to about 0.95.

3. The PDP of claim 1, wherein an aspect ratio of a subpixel is a horizontal length of the subpixel divided by a vertical length of the subpixel; and wherein the aspect ratio of the subpixel is in a range of about 1.1 to about 1.34.

4. The PDP of claim 3, wherein the aspect ratio of the subpixel is in a range of about 1.15 to about 1.25.

5. The PDP of claim 3, wherein the subpixel has a hexagonal shape.

6. The PDP of claim 1, wherein a subpixel has a vertical long axis and a vertical short axis;

wherein the subpixel is formed symmetrical to the vertical long axis; and wherein a length of the vertical long axis divided by a length of the vertical short axis is in a range from about 1.5 to about 5.

7. The PDP of claim 6, wherein the length of the vertical long axis divided by the length of the vertical short axis is in a range from about 2.5 to about 3.5.

8. The PDP of claim 1, wherein the PDP has 1280 horizontal pixels and 640 vertical pixels.

9. The PDP of claim 8, wherein the PDP is about 37 inches wide, diagonally.

10. The PDP of claim 1, wherein of the PDP has 1366 horizontal pixels and 768 vertical pixels.

11. The PDP of claim 10, wherein the PDP is about 42 inches wide, diagonally.

12. The PDP of claim 1, wherein the PDP has 1024 horizontal pixels and 512 vertical pixels.

13. The PDP of claim 12, wherein the PDP is about 32 inches wide, diagonally.

14. The PDP of claim 1, wherein the display electrodes comprise bus electrodes and transparent electrodes; and wherein the transparent electrodes protrude from the bus electrodes and are positioned in discharge spaces forming subpixels.

15. The PDP of claim 14, wherein the bus electrodes are positioned over the barrier ribs.

16. The PDP of claim 15, wherein the bus electrodes are formed in a zigzag configuration.

17. A plasma display panel (PDP), comprising:

a pixel formed between a first substrate and a second substrate;

wherein the pixel comprises three subpixels arranged in a delta arrangement;

wherein an aspect ratio of the pixel is a horizontal pitch of the pixel divided by a vertical pitch of the pixel;

wherein the aspect ratio of the pixel is in a range of about 0.8 to about 1.0;

wherein an aspect ratio of a subpixel is a horizontal length of the subpixel divided by a vertical length of the subpixel; and wherein the aspect ratio of the subpixel is in a range of about 1.1 to about 1.34.

18. The PDP of claim 17, wherein the aspect ratio of the pixel is in a range of about 0.85 to about 0.95.

19. The PDP of claim 18, wherein the aspect ratio of the subpixel is in a range of about 1.15 to about 1.25.

20. The PDP of claim 17, wherein a subpixel has a vertical long axis and a vertical short axis;

wherein the subpixel is formed symmetrical to the vertical long axis; and wherein a length of the vertical long axis divided by a length of the vertical short axis is in a range from about 1.5 to about 5.

* * * * *